US006314636B1

(12) United States Patent
Hughes

(10) Patent No.: US 6,314,636 B1
(45) Date of Patent: Nov. 13, 2001

(54) METHOD OF MANUFACTURING AN ELECTRIC HEATER ASSEMBLY

(75) Inventor: John Thomas Hughes, Stanford Bridge (GB)

(73) Assignee: Ceramaspeed Limited (GB)

( * ) Notice: Subject to any disclaimer, the term of this patent is extended or adjusted under 35 U.S.C. 154(b) by 0 days.

(21) Appl. No.: 09/137,941

(22) Filed: Aug. 21, 1998

(30) Foreign Application Priority Data

Sep. 19, 1997 (GB) ..... 9719884

(51) Int. Cl.[7] ..... H05B 3/00

(52) U.S. Cl. ..... 29/611; 29/612; 29/613; 29/614; 29/615

(58) Field of Search ..... 29/611, 831, 848, 29/850, 612, 613, 614; 219/457, 464, 467

(56) References Cited

U.S. PATENT DOCUMENTS 1,021,230 * 3/1912 Ball ..... 29/610.1
4,150,280 * 4/1979 Hurko ..... 219/461
5,296,684 * 3/1994 Essig et al. ..... 219/453

FOREIGN PATENT DOCUMENTS 0625865 11/1994 (EP) .
0757508 2/1997 (EP) .
2270824 3/1994 (GB) .

OTHER PUBLICATIONS

Search Report, Nov. 4, 1997.

* cited by examiner

*Primary Examiner*—Gregory L. Huson
*Assistant Examiner*—Sean Smith
(74) *Attorney, Agent, or Firm*—Ira S. Dorman

(57) ABSTRACT

A method of manufacturing an electric heater assembly with a plurality of electric heating units includes the steps of providing a tray-like support (1) and moulding microporous thermal and electrical insulation material into the support. The tray-like support (1) is formed with a number of dish-like recesses (2), each dish-like recess comprising a base (4) and a surrounding wall (5). The microporous thermal and electrical insulation material is moulded into each dish-like recess to form a base layer (6) against the base (4) of each dish-like recess and an upstanding wall layer (7) against the surrounding wall (5) of each dish-like recess, the base layer (6) being formed integrally with the wall layer (7). At least one electric heating element (12) is provided in each dish-like recess (2), the heating element being supported on or adjacent to the base layer (6). The electric heater assembly is adapted for use behind a plate (10) to provide a plurality of discrete heating zones on the plate.

27 Claims, 3 Drawing Sheets

METHOD OF MANUFACTURING AN ELECTRIC HEATER ASSEMBLY

This invention concerns a method of manufacturing an electric heater assembly with a plurality of electric heating units, for use behind a plate such as a glass-ceramic plate in a cooking appliance, to provide a plurality of discrete heating zones on the plate.

DESCRIPTION OF PRIOR ART

For many years it has been most common practice to design glass-ceramic top cooking appliances in which a plurality of discrete electric heating units are provided underneath and in contact with a sheet of glass-ceramic and in which each heating unit is formed in an individual metal dish-like support and individually held against the underside of the glass-ceramic sheet. Recent trends have been aimed at simplifying manufacture by forming a plurality of heating units directly on a common supporting tray which is then secured in contact with the underside of the glass-ceramic sheet. One such arrangement is described in European Patent Publication No. 0757508 in which individual components of a plurality of heating units are built up on a common tray-like support. In this arrangement, for each heating unit a tablet-form base of insulation material and a separate insulating wall are assembled on the base of the support, one or more heating elements being secured to the base.

An arrangement of securing clips is used to secure the components to the support.

OBJECT OF THE INVENTION

It is an object of the present invention to provide a method of manufacturing a heater assembly in which rather than separately form the insulation components and then build them up on the tray-like support, the insulation components are integrally formed directly on the support and no securing clips are required.

SUMMARY OF THE INVENTION

The present invention provides a method of manufacturing an electric heater assembly with a plurality of electric heating units, for use behind a plate, in particular a glass-ceramic plate, to provide a plurality of discrete heating zones on the plate, the method comprising:

- providing a tray-like support having formed therein a plurality of dish-like recesses, each dish-like recess comprising a base and a surrounding wall;
- moulding into each dish-like recess microporous thermal and electrical insulation material to form a base layer against the base of each dish-like recess and an upstanding wall layer against the surrounding wall of each dish-like recess, the base layer being formed integrally with the wall layer; and
- providing in each dish-like recess at least one electric heating element supported relative to (that is, on or adjacent to) the base layer.

The microporous thermal and electrical insulation material may be moulded into the dish-like recesses one at a time, or all or a plurality thereof at the same time.

The upstanding wall layer of insulation material may be provided of a height in each dish-like recess such that it has an upper surface for contacting the plate, such as the glass-ceramic plate, when the heater assembly is arranged for operation. The upper surface of one or more of the wall layers may be profiled such as to be higher at the centre than at the edges.

The base layer in each dish-like recess may be provided having a compaction density substantially the same as, or different from, that of the upstanding wall layer. It may be preferred for the wall layer to have a compaction density greater than that of the base layer.

The base layer in each dish-like recess may have a composition substantially the same as, or different from, that of the upstanding wall layer, although formed integrally therewith.

The base layer and/or the wall layer in each dish-like recess may include reinforcing glass filaments. Such filaments may, for example, be selected from E glass, R glass, S glass and silica.

The microporous insulation material may be moulded into each dish-like recess as described in British Patent Application No. 9705923.2.

The at least one electric heating element provided in each dish-like recess may be of ribbon form and may be secured to the base layer in each dish-like recess by partial embedding in the base layer. Such partial embedding of the at least one heating element may be effected during moulding of the insulation material into each dish-like recess.

The at least one ribbon-form heating element may be provided partially embedded edgewise in the base layer of each dish-like recess and may be of corrugated form.

The tray-like support may be of metal and may be fabricated from component parts or the plurality of dish-like recesses may be formed, for example, by stamping, drawing, pressing, or otherwise shaping, a basic sheet-form metal component.

The tray-like support may be formed with a peripheral edge adapted to receive the plate. The plate may be secured to the peripheral edge by means of an adhesive or may be secured by mechanical fixing means. Sealing means, such as a gasket, may be provided between the plate and peripheral edge.

The plate may preferably be a glass-ceramic plate and may be for use in a cooking appliance.

The invention is now described by way of example, with reference to the accompanying drawings; in which:

DESCRIPTION OF PREFERRED EMBODIMENTS

Figure 1A:
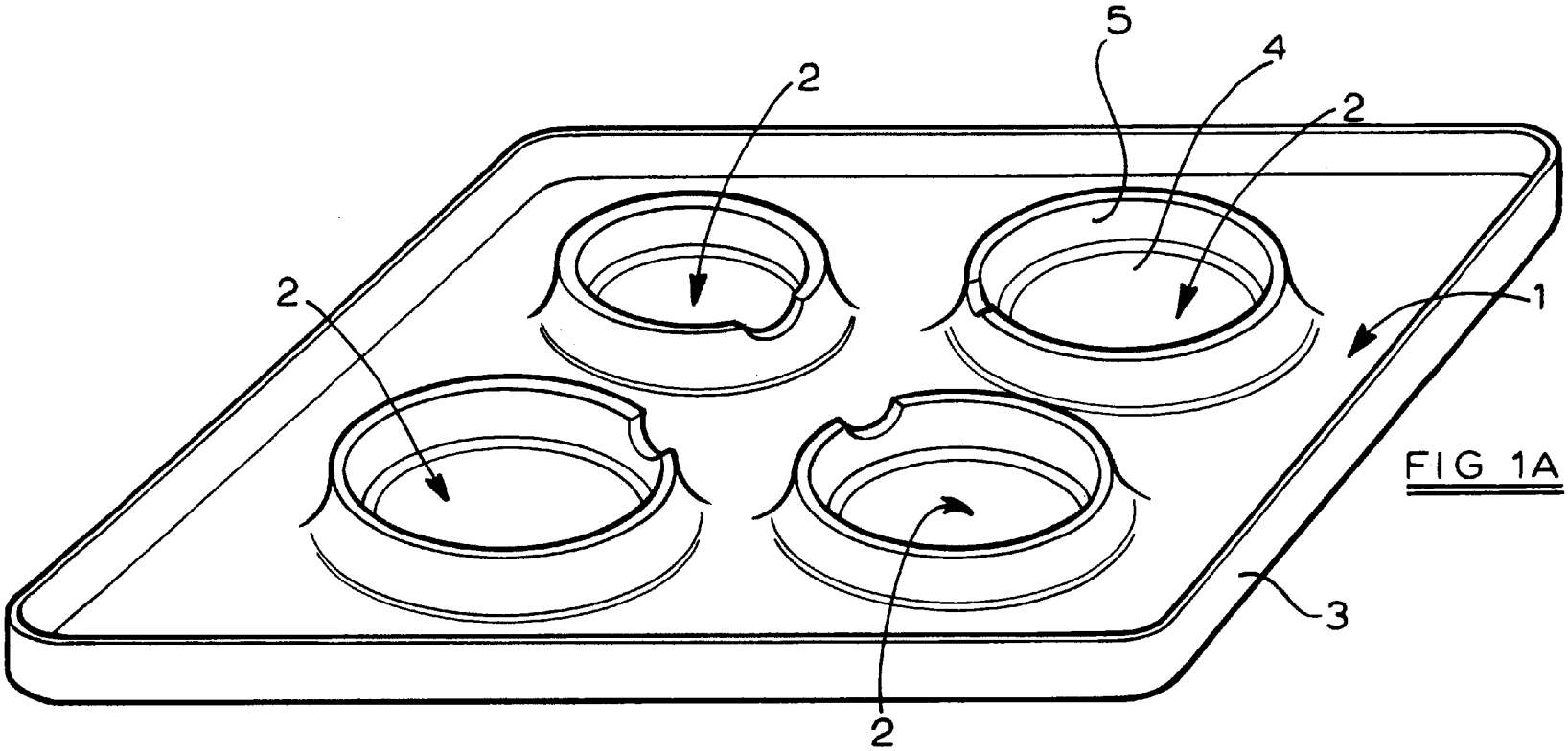
FIGS. 1A, 2A and 3A, are perspective views of an electric heater assembly during various manufacturing stages thereof according to the method of the invention.
Figure 1B:
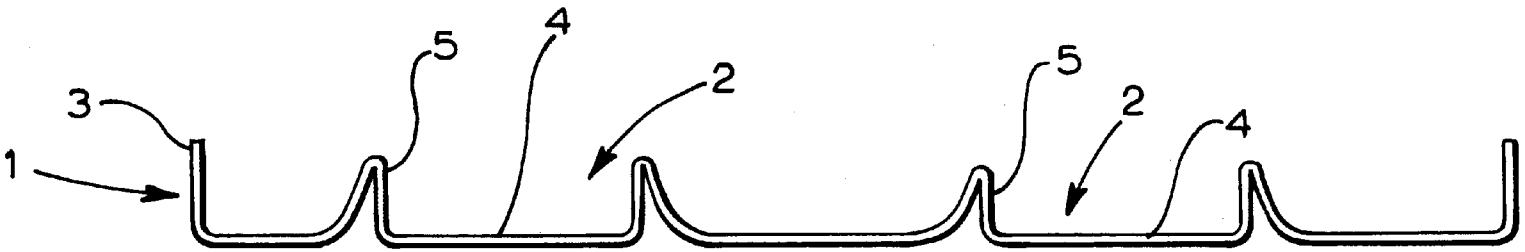
FIGS. 1B, 2B and 3B are cross sectional views of the assembly of FIGS. 1A, 2A and 3A respectively.

Referring to FIGS. 1A and 1B, a tray-like support 1 is provided for use in an electric heater assembly, starting with a metal sheet, such as of steel, which is processed such as by pressing, stamping or drawing, to form a plurality of dish-like recesses 2 therein and, optionally, an upturned edge rim 3. Alternatively the tray-like support 1 with the recesses 2 may be fabricated from component parts. Such dish-like recesses 2 form the basis of electric heating units and although four are shown in FIG. 1A, any required number could be provided. Each dish-like recess 2 comprises a base 4 and a surrounding wall 5.

Figure 2A:
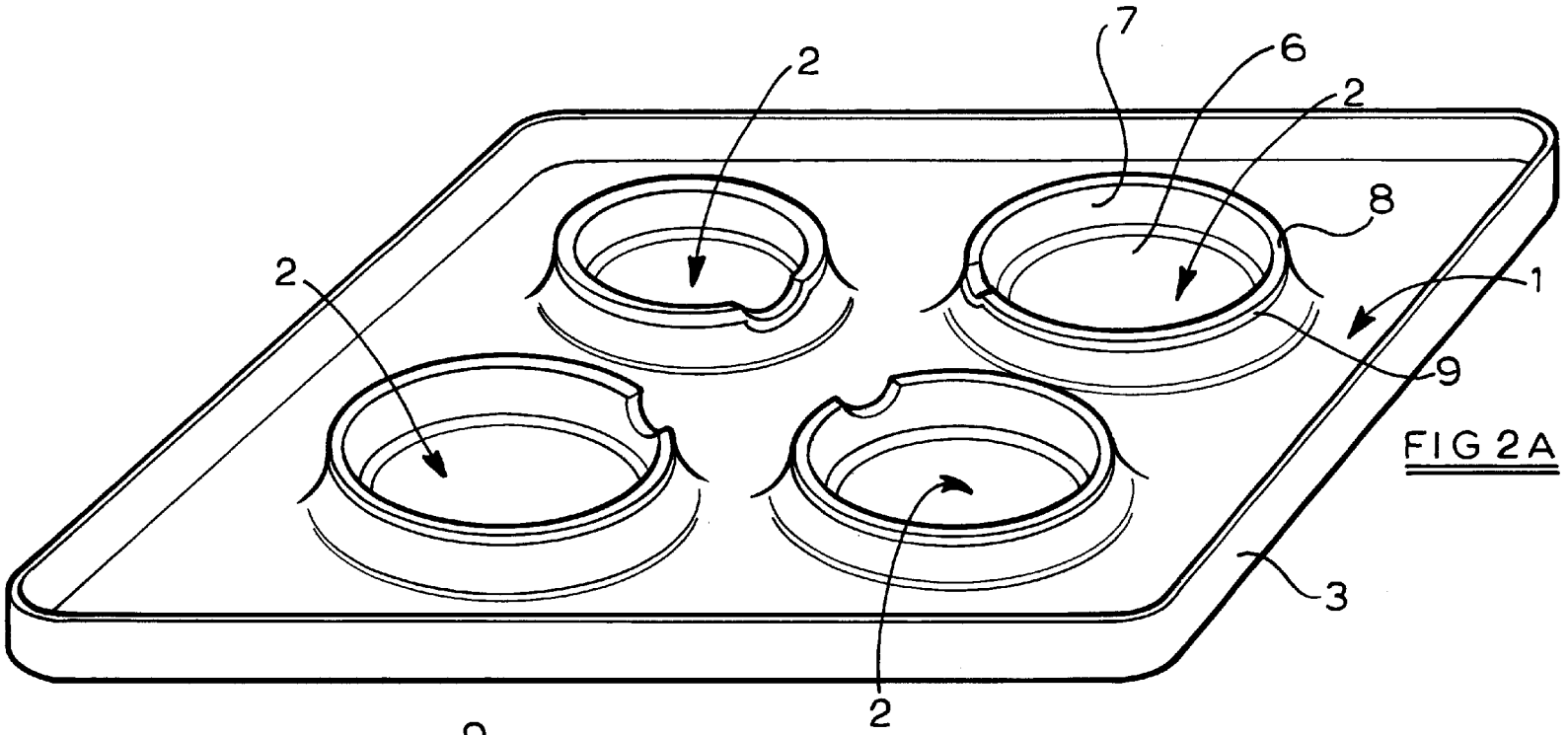
Figure 2B:
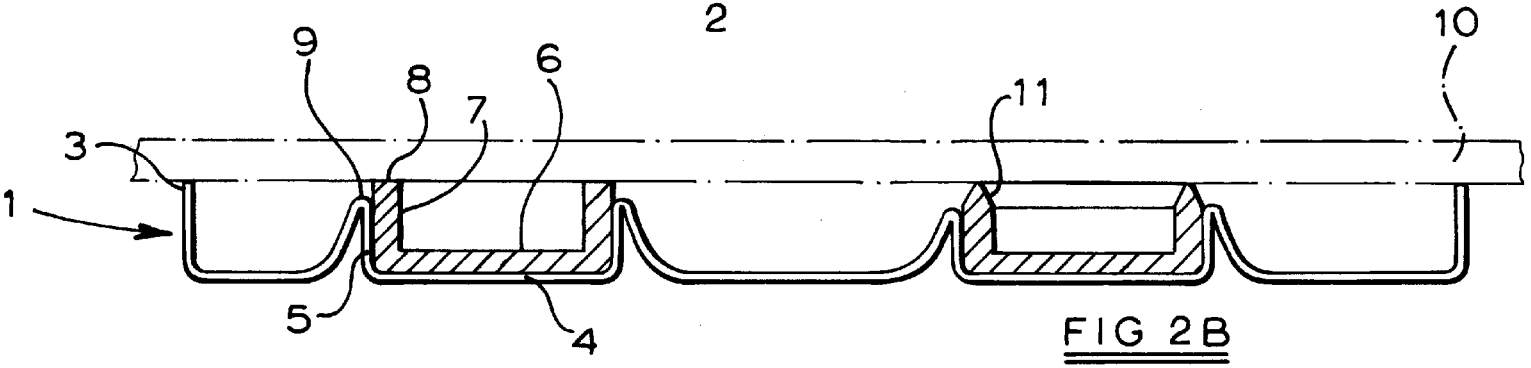

Referring now to FIGS. 2A and 2B, microporous thermal and electrical insulation material is moulded into each dish-like recess to form a base layer 6, against the base 4 of each dish-like recess 2, and an upstanding wall layer 7, against the surrounding wall 5 of each dish-like recess 2. The base layer 6 of insulation material is formed integrally with the wall layer 7 in each dish-like recess 2. The insulation material may be moulded into the dish-like recesses 2 either one at a time, or all or a plurality thereof at the same time.

Each wall layer 7 of insulation material is provided of such a height that it has an upper surface 8 which protrudes slightly above the top 9 of the surrounding wall 5 of each dish-like recess 2. The upper surface 8 of each wall layer is optionally arranged for subsequently contacting the rear surface of a plate 10, such as a glass-ceramic plate, and may be profiled 11 such as to be higher at the centre than at the edges.

The microporous insulation material, which is well known to the skilled person, is moulded into the dish-like recesses 2 to form the base layers 6 and wall layers 7 by compacting powdered insulation material into the dish-like recesses 2. A particularly suitable method for providing the integral base layers 6 and wall layers 7 in a common processing operation is described in British Patent Application No. 9705923.2. The base layer 6 in each recess 2 may be provided having a compaction density substantially the same as, or different from that of the wall layer 7. It may be preferred for each wall layer 7 to have a greater compaction density than that of each corresponding base layer 6. For example, the wall layers 7 may have a compaction density of about 350 kg/m$^3$ and the base layers 6 may have a compaction density of about 300 kg/m$^3$.

The base layer 6 in each recess 2 may have a composition substantially the same as, or different from, that of the wall layer 7, although formed integral therewith. An example of a particular composition for each wall layer 7 is:

| | |
|---|---|
| Pyrogenic silica | 62 percent by weight |
| Opacifier (Rutile) | 27 percent by weight |
| E glass filaments | 11 percent by weight |

Each base layer 6 may, for example, comprise:

| | |
|---|---|
| Pyrogenic silica | 60 percent by weight |
| Opacifier (Rutile) | 37 percent by weight |
| Ceramic fibres | 3 percent by weight |

However, glass filaments, such as for example filaments of S glass or silica, may be used in place of the ceramic fibres. Alternatively, E glass or R glass filaments may be incorporated as permitted by operating temperatures of the heater units in the heater assembly being manufactured.

Figure 3A:
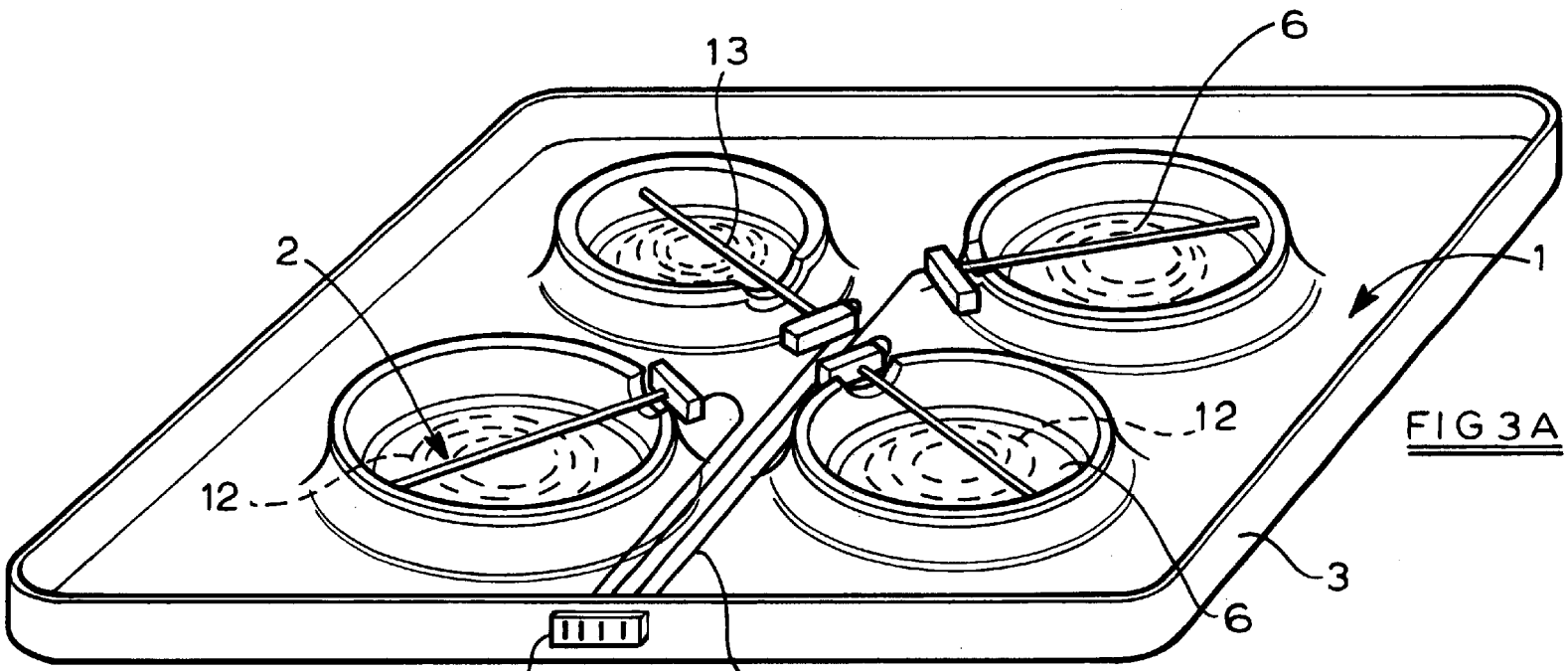
Figure 3B:
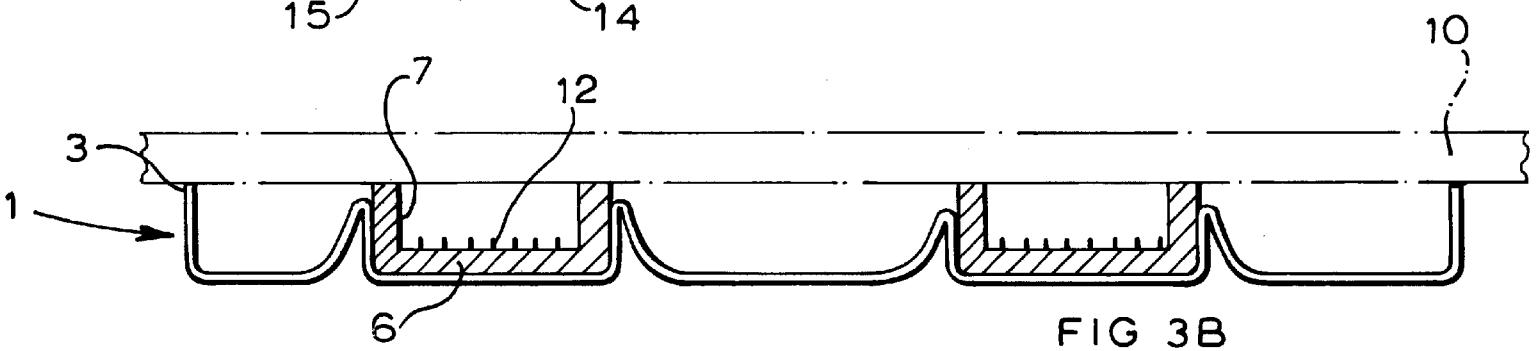

Referring now to FIGS. 3A and 3B, at least one heating element 12 is provided in each dish-like support 2, on or adjacent to the base layer 6 of microporous insulation material. Any of the well-known forms of heating element may be considered, such as, for example: coiled wire or ribbon; or flat or edgewise mounted ribbon of planar or corrugated form; or one or more heating lamps, particularly halogen lamps. However it is particularly convenient to provide one or more ribbon elements, particularly of corrugated form, partially embedded, particularly edgewise, in the surface of each base layer 6. Such one or more heating elements may be secured by partial embedding in each base layer 6 during the process of moulding the microporous insulation material into the recesses 2 to form the base layers 6 and upstanding wall layers 7. This is achieved, for example, as described in British Patent Application No. 9705923.2.

A well-known form of temperature limiter 13 is provided, extending over the heating element or elements 12 in each dish-like recess 2, the surrounding wall 5 of each recess 2 and also the wall layer 7 being cut away to facilitate location of each limiter.

As a result, four heating units are provided formed in the four dish-like recesses 2 of the tray-like support 1.

Electrical connecting leads 14 are provided in the tray-like support and extending from each resulting heating unit to a terminal block 15 on the rim 3 of the support, whereby the resulting heater assembly may be connected to an external power supply.

The resulting heater assembly may be supported against the rear side of a plate 10, such as a glass-ceramic cooking plate of well known form, in a cooking appliance.

The peripheral edge 3 of the tray-like support 1 may be suitably adapted to receive the plate 10. The plate 10 may be secured to the peripheral edge by means of an adhesive or by mechanical fixing means (not shown). If required, sealing means, such as a gasket, may be provided between the plate 10 and the peripheral edge 3.

I claim:

1. A method of manufacturing an electric heater assembly with a plurality of electric heating units produced upon a common support, for use behind a plate to provide a plurality of discrete heating zones on the plate, the method comprising:

providing a generally planar support having a plurality of concave recesses therein, each recess comprising a base and a surrounding wall;

moulding into each recess microporous thermal and electrical insulation material, in powder form, to thereby form in each recess a structure consisting of a base layer disposed against the base of each recess and an upstanding wall layer disposed against the surrounding wall of each recess, the base layer and wall layer of said structure in each recess being integrally formed as a single piece; and providing in each recess at least one electric heating element supported relative to the base layer.

2. A method according to claim 1, wherein the microporous thermal and electrical insulation material is moulded into the recesses one at a time.

3. A method according to claim 1, wherein the microporous thermal and electrical insulation material is moulded into all the recesses at the same time.

4. A method according to claim 1, wherein the microporous thermal and electrical insulation material is moulded into a plurality of the recesses at the same time.

5. A method according to claim 1, wherein the upstanding wall layer of insulation material is provided of a height in each recess such that it has an upper surface for contacting the plate, when the heater assembly is arranged for operation.

6. A method according to claim 5,, wherein the upper surface of one or more of the upstanding wall layers is profiled such as to be higher at the centre thereof than at the edges.

7. A method according to claim 1, wherein the base layer in each recess is provided having a compaction density substantially the same as that of the upstanding wall layer.

8. A method according to claim 1, wherein the base layer in each recess is provided having a compaction density different from that of the upstanding wall layer.

9. A method according to claim 8, wherein the wall layer has a compaction density greater than that of the base layer.

10. A method according to claim 1, wherein the base layer in each recess has a composition substantially the same as that of the upstanding wall layer.

11. A method according to claim 1, wherein the base layer in each recess has a composition different from that of the upstanding wall layer, although formed integrally therewith.

12. A method according to claim 1, wherein at least one of the base layer and the wall layer in each recess includes reinforcing glass filaments.

13. A method according to claim 12, wherein the glass filaments are selected from E glass, R glass, S glass and silica.

14. A method according to claim 1, wherein the at least one electric heating element provided in each recess is of ribbon form.

15. A method according to claim 14, wherein the at least one ribbon form heating element is secured to the base layer in each recess by partial embedding in the base layer.

16. A method according to claim 15, wherein the at least one ribbon form heating element is secured to the base layer in each recess during moulding of the insulation material into each recess.

17. A method according to claim 15, wherein the at least one ribbon-form heating element is provided partially embedded edgewise in the base layer of each recess.

18. A method according to claim 17, wherein the at least one ribbon-form heating element is of corrugated form.

19. A method according to claim 1, wherein the support is of metal.

20. A method according to claim 19, wherein the support is comprised of a plurality of discrete components.

21. A method according to claim 19, wherein the recesses are integrally formed in the support by a method selected from the group consisting of stamping, drawing and pressing a sheet metal component.

22. A method according to claim 1, wherein the support is formed with a peripheral edge adapted to receive the plate.

23. A method according to claim 22, wherein the plate is secured to the peripheral edge by means selected from an adhesive and mechanical fixing means.

24. A method according to claim 22, wherein sealing means is provided between the plate and the peripheral edge.

25. A method according to claim 24, wherein the sealing means comprises a gasket.

26. A method according to claim 1, wherein the plate comprises a glass-ceramic plate.

27. An electric heater assembly whenever manufactured by the method of claim 1.

* * * * *